United States Patent [19]

Faulconer et al.

[11] Patent Number: 4,913,589

[45] Date of Patent: Apr. 3, 1990

[54] DIVER'S BUOYANCY COMPENSATOR AND BACKPACK WITH INDEPENDENT SUSPENSION

[75] Inventors: Mark Faulconer, Costa Mesa; Scott E. Greatrake, San Clemente, both of Calif.

[73] Assignee: U.S. Divers Company, Inc., Santa Ana, Calif.

[21] Appl. No.: 233,153

[22] Filed: Aug. 17, 1988

[51] Int. Cl.[4] ..... B63C 9/16

[52] U.S. Cl. ..... 405/186; 441/108; 441/118; 441/88; 114/315

[58] Field of Search ..... 405/186, 185; 441/108, 441/123, 88, 118, 116, 111

[56] References Cited

U.S. PATENT DOCUMENTS

| | | | |
|---|---|---|---|
| 3,475,774 | 11/1969 | Hawkins | 441/118 |
| 4,016,616 | 4/1977 | Walters | 405/186 |
| 4,523,914 | 6/1985 | Faulconer et al. | 441/108 |
| 4,694,772 | 9/1987 | Faulconer et al. | 405/185 X |
| 4,810,134 | 3/1989 | Faulconer et al. | 405/185 X |

*Primary Examiner*—Dennis L. Taylor

*Attorney, Agent, or Firm*—George F. Bethel; Patience K. Bethel

[57] ABSTRACT

The specification herein sets forth a combination buoyancy compensator, backpack and suspension system for divers. The suspension system incorporates a spider which is made of elastomeric foam and a knitted material that conforms closely to a user's body. The backpack is formed from an inverted T, the lateral portions of which surround a user's waist and the upright portion is adapted for receipt of a cylinder of breathing gas. The buoyancy compensator is attached to the spider at the shoulder portions and the waistband portions. The attachment is by means of adjustable loops which allow for independent suspension of the buoyancy compensator so that when it is filled it does not bind a diver. The straps interconnecting the spider, shoulder portions and the waistband portion are in a crisscross configuration to allow for freedom of movement of a diver's arms.

22 Claims, 3 Drawing Sheets

DIVER'S BUOYANCY COMPENSATOR AND BACKPACK WITH INDEPENDENT SUSPENSION

BACKGROUND OF THE INVENTION

This invention resides within the field of underwater diving. More particularly, it resides within the field of providing an underwater diver with buoyancy compensation and the ability to carry a tank of underwater breathing gas. It specifically is directed toward buoyancy compensation and the support of such underwater breathing gas tanks through a support means on the shoulders and back of a user. The buoyancy compensator is freely independent from the respective elements of the backpack and support means.

THE PRIOR ART

The prior art with respect to buoyancy compensators includes vest type buoyancy compensators. These compensators were in the nature of a life vest which was merely inflated or deflated to provide for buoyancy trim or compensation to a diver.

As time went on, the art developed buoyancy compensators which surrounded a user's back and front to provide uniform buoyancy compensation around a user's torso. Such buoyancy compensators were inflated and deflated by oral as well as power inflation means. When the oral or power inflation means were utilized, they allowed for increased buoyancy at greater depth to overcome the fact that a diver's buoyancy decrease as he dives deeper. This is due to the fact that with greater pressure a loss takes place with regard to the lifting characteristics of the diver's inherent buoyancy, not only as to the diver but also his wetsuit and equipment.

As the diver approaches the surface, his natural buoyancy tends to increase. Accordingly, the buoyancy compensator can have gas released from the buoyancy compensator chamber to compensate for a diver's change in buoyancy.

Fundamentally, the diver ideally tries to trim his buoyancy to a neutral state by increasing or decreasing the buoyancy provided by the buoyancy compensator. This, of course, is provided by either adding gas to the buoyancy compensator or releasing it.

The Applicant is specifically knowledgeable about certain buoyancy compensators that he has developed in the art. It is felt that the closest buoyancy compensators to this particular application are shown in U.S. Pat. Nos. 4,523,914 and 4,690,314. In these particular patents, it can be seen that the buoyancy compensator is attached to the back of a user directly. When attached to the back of a user, it provides for an uncomfortable feeling. As it expands and contracts, it specifically does so against the surface of a diver's body.

Buoyancy compensators have been utilized to hold a diver's backpack on the back. It was felt in this manner that the straps of the buoyancy compensator would not cut into the diver's shoulders. It was felt that the more buoyant and pneumatic nature of a buoyancy compensator across a user's shoulders would provide greater comfort. This is true particularly when the backpack was supported on the buoyancy compensator.

A recent innovation with regard to backpacks was shown in U.S. Pat. No. 4,690,314, entitled Buoyancy Compensator Insertable Backpack. This particular backpack as can be seen, is not only against a user's back, but also bends around a user's waist in order to provide for support of a container or tank of pressurized gas on a user's back. In this particular case, the backpack when residing on a user's waist and back still has a buoyancy compensator supported in the manner that is detrimental to its use.

Another development in the art has been a buoyancy compensator belt which specifically was made to circumscribe a user's waist. This was set forth in U.S. Pat. No. 4,694,772. In circumscribing a user's waist, it was meant to conform to the configuration of a wetsuit. However, in this particular invention, the buoyancy compensator was still in contact in great measure with the user's body. Furthermore, the support of the breathing gas tank on a user's back inhibited the ability of a user to operate effectively in an independent manner from the backpack in combination with the buoyancy compensator.

Although the foregoing advances over the art were deemed to be successful and met with a degree of commercial success, the invention herein overcomes the independent deficiencies of each of the elements of the foregoing art. It eliminates many of the problems associated with the prior art in their individual state by providing a combination of elements not suggested by the prior art.

It was not deemed obvious or suggestive to one skilled in the art at the time this invention was made, nor in view of any of the art as cited known by the inventor to overcome these deficiencies by the specific invention at hand.

A specifically novel feature of this invention over the prior art is that it allows for independent expansion and contraction of a buoyancy compensator from the suspension of a diver's equipment. It specifically allows for the expansion of the buoyancy compensator in a manner completely independent from but at the same time suspended to the diver. The suspension is especially enhanced by virtue of the fact that it is attached to a diver's shoulder and a diver's waist in a manner to provide for independence such that there is no connection to a diver in the waist and shoulder area to inhibit movement.

The invention also allows for a buoyancy compensator to be attached to a backpack without the requirement of attachment to the suspension means. Additionally, the suspension means are such wherein they can be adjusted in a facile and comfortable manner.

The invention overcomes the problems of the prior art by providing a suspension means over the shoulders, around the back and in the waist area which is independent of the other elements of the diving equipment. This is due to the fact that the suspension equipment is a combination of knit material and foam cellular material that can expand and contract at various depths. It maintains a degree of uniformity and association with a diver's body in its expansion and contraction. This being the case, it expands and contracts around a user's body in a uniform and effective manner not seen in the prior art straps that overlie a user's shoulders and oftentimes cut into a user's shoulder.

In addition to the foregoing features, this invention incorporates a cross shoulder harness relationship. The cross shoulder harness relationship allows for each respective shoulder harness to extend to an opposite side of a user's waistband. By doing this, it allows for more uniform expansion and contraction. It is particularly helpful with regard to the female anatomy in crossing over a user's chest area to prevent binding across a female user's front. This is particularly beneficial when considering the fact that tight expansion and contraction of a buoyancy compensator and the straps attendant therewith tend to bind and inhibit a user's movement.

Based upon the foregoing, it is believed that this invention is a substantial step over the prior art and is a combination improvement which enhances a diver's overall efficiency and comfort.

SUMMARY OF THE INVENTION

In summation, this invention comprises a buoyancy compensator and support system for the buoyancy compensator and a backpack for breathing gas having an improved fit with the provision of greater freedom of movement without chest restrictions, as well as independent suspension allowing the bladder to inflate away from the diver to alleviate binding pressure yet remain secure when in use.

More particularly, the invention incorporates a buoyancy compensator that is independently suspended. The independent suspension is provided in a manner whereby it is attached to a diver's body by means of a neoprene unitized spider. The spider incorporates two respective shoulder resting areas or portions and two respective belt or waiststrap areas. The respective shoulder portions cause the buoyancy compensator to be suspended across a user's shoulders in an independent manner.

The unitized spider is made of a neoprene which expands and contracts for comfort and specifically changes with respect to depth due to the cellular construction of the neoprene in its respective expansion and contraction mode, depending upon depth.

The spider is interconnected by the shoulder harness areas being connected to the waistband areas through straps. These straps in a preferred embodiment crisscross over a user's body. This allows for greater freedom of movement within the shoulder and arm area. The freedom of arm movement is also enhanced by the extra stability of the crisscross design of the straps interconnecting the spider.

The entire combination serves to support a backpack with a cylinder of breathing gas thereon. The backpack with the buoyancy compensator is such wherein the buoyancy compensator is independent, while at the same time is securely attached to the diver along with the backpack and the cylinder of gas thereon. This combination enhances the capability of a diver to not only function but also alleviates binding and increases comfort.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
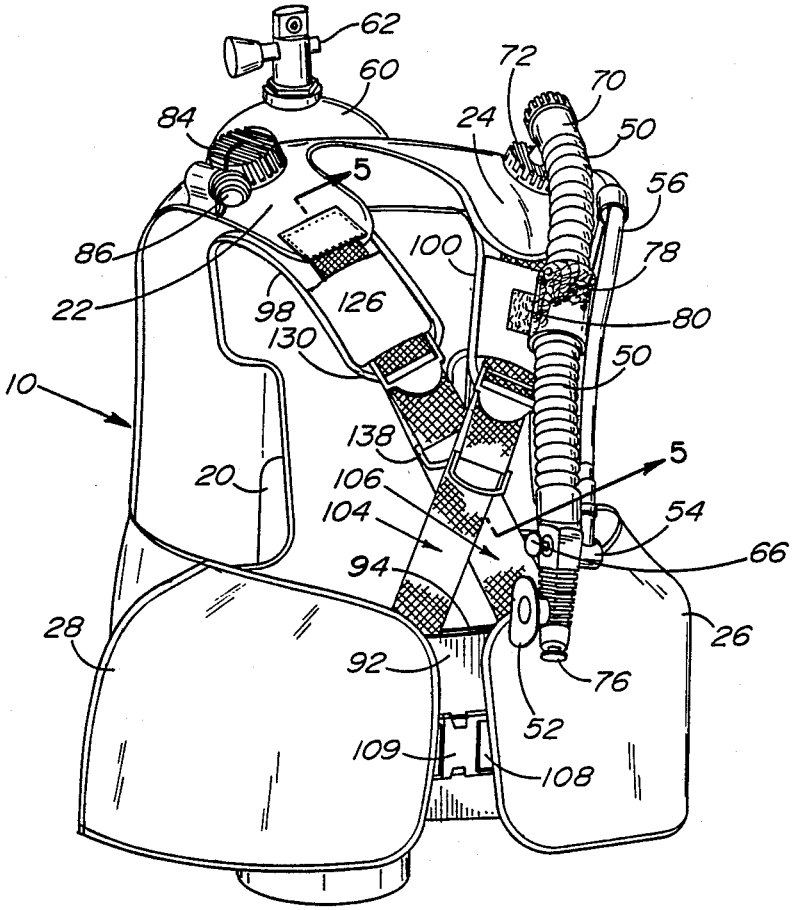
FIG. 1 shows a frontal perspective view of the buoyancy compensator, spider, with a breathing gas tank or cylinder attached to the backpack of the invention.

FIG. 1 shows a perspective frontal view of the buoyancy compensator and independent support means with the backpack of this invention having a tank or gas cylinder attached thereto. The unit incorporates a buoyancy compensator 10 having a back portion 12 which is split with an opening in the form of two downwardly projecting sections 16 and 18. The opening 20 can be seen that is split along the back of the buoyancy compensator to accommodate a tank against the backpack portion. The buoyancy compensator has shoulder portions 22 and 24 that do not contact the user's shoulders, but are attached in the manner and secured by a spider as will be detailed hereinafter.

The buoyancy compensator also has two waist portions 26 and 28. The waist portions 26 and 28 circumscribe a user's waist in part. The partial circumscribing of the waist helps to provide a balance to the user for purposes of neutral buoyancy. It is found to be more effective to have buoyancy provided close to the center of the body than in an extremity or other remote area.

The buoyancy compensator can be formed of any material such as a nylon or other woven material having a plastic inner sealant or coating. Looking more specifically at FIG. 2, it can be seen that the buoyancy compensator has voids 34 and 36. The voids 34 and 36 in the respective waist areas or portions 26 and 28 are formed by sealing two major sheets of material at the edge regions 38 and 40. The edge regions circumscribe the buoyancy compensator around its entirety thereof and are bound by a ribbon of material 44 that can be seen around the entire buoyancy compensator.

The voids 34 and 36 are contiguous voids that extend through the entire buoyancy compensator, including the back areas 12, 16 and 18, as well as the shoulder areas 22 and 24. These contiguous voids can be seen in the shoulder area as voids 46 and 48. Voids 46 and 48 have been exemplified as being the voids in the shoulder area but are contiguous and continuously connected with those voids 34 and 36 in the waist area by virtue of the continuity of the void in the buoyancy compensator extending down the back and into the waist areas.

The buoyancy compensator is served by valving and filling apparatus which is connected thereto. In particular, an inflator tube 50 is shown that is connected to a mouthpiece 52 and a high pressure filling connection 54. The high pressure filling connection 54 is connected by a tube 56 to a first stage regulator attached to a tank of high pressure gas, namely high pressure tank or cylinder 60. The high pressure tank 60 has a valve 62 which can receive a regulator thereover as is known in the art.

The inflator tube 50 can be filled by depressing a button 66 interconnecting the high pressure line 56 through the connector 54 to the inflator tube. Gas then flows through the inflator tube into the buoyancy compensator through a fitting 70 connected by means of an enlarged mushroom connector 72 to the buoyancy compensator.

In the eventuality oral inflation is desired, one can blow through the mouthpiece 52 and depress valve button 76 to fill the buoyancy compensator also through the inflator tube 50.

The inflator tube 50 can be secured by means of a velcro strap 78 to a piece of velcro 80 stitched to the spider.

The buoyancy compensator also incorporates an overpressure relief valve member 84. The overpressure relief valve member 84 is shown with a protective grid thereover and a pull cord 86 for purposes of manually dumping air from the buoyancy compensator.

The two foregoing inflating and valving members allow for trimming of the buoyancy compensator to the desired buoyancy that a diver requires.

Internally of the buoyancy compensator is the supporting spider 90. The spider 90 comprises a waistband portion comprising waistband or side portions 92 and 94. These waistband side portions circumscribe a user's waist. The spider 90 extends upwardly through a mid back section 96 or spine portion and terminates in two shoulder portions 98 and 100. The two shoulder portions 98 and 100 can be seen extending downwardly over the shoulders in FIG. 1.

The shoulder portions 98 and 100 rest on one's shoulders and are secured by means of straps which will be detailed hereinafter. Based upon the side portions 92 and 94 surrounding a user's waist and the shoulder portions 98 and 100 overlapping a user's shoulders and in turn being connected to the side portions 92 and 94, a secure spider type support is wrapped over the user's back, waist and shoulders. The user's back and in particular the back portion 96 or spine portion allows for a significant securement of the spider 90 around a user's back and waist portions, as well as over the shoulders. The securement is enhanced by the fact that the material, as will be set forth hereinafter, engages the body in a snug manner with an elastomeric foam contact to allow it to expand and contract with regard to the body.

In order to secure the spider 90 to the body, a set of securement straps 104 and 106 are shown. The securement straps 104 and 106 have attachments to the shoulder portions 98 and 100 as set forth hereinafter. The securement straps 104 and 106 are detailed in a sectional view in FIG. 5 to show how they are attached and how they cinch the spider into a tightened position around a user's body.

Each waistband portion 92 and 94 terminates in overlapping relationship when secured. The securement means is a velcro attachment as shown in U.S. Pat. No. 4,694,772. In order to secure the waistband portions 92 and 94, a belt 108 circumscribes the interior of the buoyancy compensator and exterior of the waistband portions 92 and 94. The belt 108 is such wherein it wraps around the interior of the buoyancy compensator and the exterior of the waistband portions 92 and 94 to form an inner connection through loops which are secured to the buoyancy compensator and waistband portions. The loops which can be limited in number connect the belt 108 to the waistband portions and buoyancy compensator similar to the foregoing U.S. Pat. No. 4,694,772. This allows an overall enhancement of the buoyancy compensator. It provides independent suspension away from the waistband and at the same time is secured thereto for providing buoyancy at connection points to a diver's waistband portion 92 and 94 which are secured around the diver by the belt 108.

Figure 3:
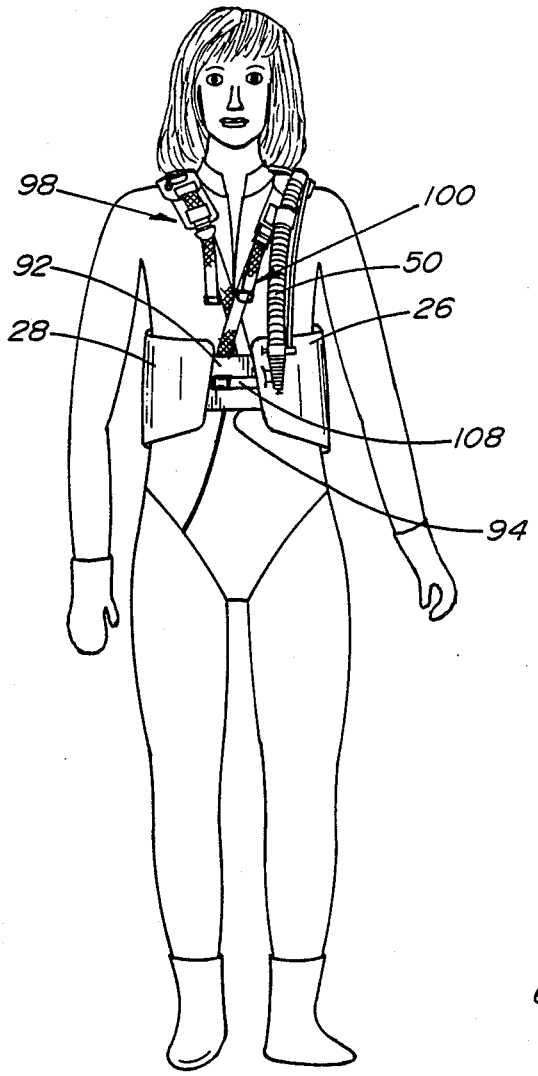
FIG. 3 shows a view of the buoyancy compensator on a diver.

Looking more particularly at FIG. 3, it can be seen wherein the waistband portions 92 and 94 terminate in overlapping relationship and the belt 108 overlies both of them. This secures the outer portions of the sides 26 and 28 of the buoyancy compensator into a secure relationship around a user's waist.

As seen in FIG. 3, the side portions 26 and 28 wrap around a user's waist and are effective in providing buoyancy compensation at a mid point area around a user's waist. The back portions of the buoyancy compensator and spider cannot be seen readily because they are generally within the back area and cannot be observed from the front end. However, as can be appreciated, with different sizes and configurations of users, the overall appearance and spread of the back portion of the buoyancy compensator can overlap around a person's back and toward the sides. Suffice it to say, the provision of buoyancy at the sides and over the back with freedom of arm movement through the strap portions 98 and 100 creates an optimum condition for movement, flexibility, facile involvement in diving, while at the same time providing well placed buoyancy.

Of significant import is the fact that the spider 90 as it is secured around a user's waist, is maintained in a secure manner while at the same time, it anchors and holds the buoyancy compensator in a locale to the user's body without inhibiting movement. This can be seen more readily in FIG. 5.

Figure 5:
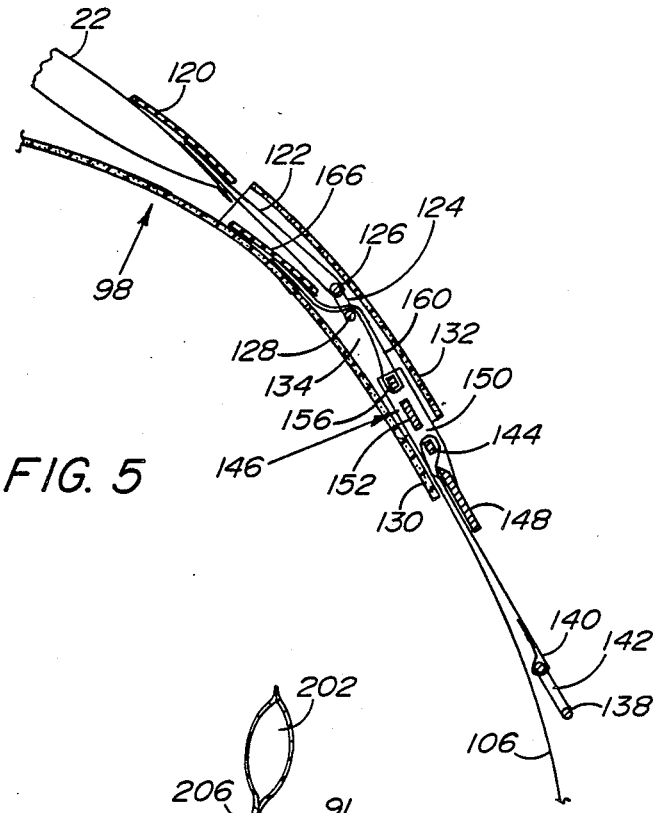
FIG. 5 shows a partially fragmented and sectional view along lines 5—5 of FIG. 1 of the adjustment strap of this invention as attached to the spider and wherein the buoyancy compensator has been attached to the spider through the means of a looped strap.

FIG. 5 shows the right hand shoulder area or portion of the buoyancy compensator 22 in its inflated state. Attached to the buoyancy compensator portion is a stitched patch 120. The stitched patch 120 secures a loop 122 formed by a strap or fabric belting. Loop 122 is attached to the spider by means of a rectangular belt loop formed of plastic or metal. This is shown as rectangular loop 124 having cross members 126 and 128 with lateral portions spanning them. Fundamentally, the loop 124 is like a rectangular box loop with cross sectionally rounded portions 126 and 128.

Thus, the buoyancy compensator shoulder portion as can be seen, namely portion 22 is independently suspended from the spider 90 as will be set forth hereinafter.

Looking more particularly at the spider 90, it can be seen that the shoulder portion 98 thereof has been shown. The shoulder portion 98 terminates at a terminal point which has been rounded at point 130. This rounded portion forms a tongue with a channel thereover created with an overlying piece of fabric 132. The overlying piece of fabric 132 forms a channel 134 passing between the fabric 132 and shoulder portion 98. The fabric 132 extends in a loop between the mid point of the shoulder portion 98 and the tongue 130. The channel 134 interior provides for a nip against the loop 122 and a second securement means for the buoyancy compensator straps.

Looking more particularly at the buoyancy compensator straps, it can be seen wherein the major strap portion 106 has a handle 138. The handle 138 is connected to the strap 106 by means of an overlapped loop of belting or fabric of the strap which is stitched back on the strap 106. The handle 138 is a D ring with two cross portions and a lateral portion as is the case with most D rings so that one can put one's fingers into the opening 142 and pull downwardly on the strap 106. When pulling downwardly on the strap 106, it can be seen wherein the strap passes over a cross member 144.

The cross member 144 is part of a handle member and/or interconnection 146. The handle member or interconnection 146 comprises a tab element 148 connected by lateral side walls 150 to the cross bar 144 around which the strap 106 is looped. A reinforcing portion 152 provides for a bridge or strut support between the side members 150. A terminal cross bar portion 156 is shown. This cross bar 156 helps for adjustable securement of the spider 90 and the buoyancy compensator. The cross bar 156 of the entire handle device 146 has a loop of fabric or strap 160 passing around it with the double layer thereof passing over the portion 128 of the rectangular ring and wherein both tail portions are stitched down and secured by a patch 166.

The patch 166 thereby secures the rectangular loop 124 with the looped strap 122 thereto. It also serves to secure the handle or interconnecting member 141 by means the cross member 156 securing the loop of the strap 160. Thus, when the handle member or D ring 138 is pulled downwardly it tends to pull the cross member 144 and the entire handle or interconnecting device 146 downwardly. This in turn pulls the cross member 156 of handle portion 146 downwardly, thereby cinching down on the rectangular loop 124 and attendantly pulling the buoyancy compensator shoulder portion 22 downwardly therewith. This entire function thereby adjusts the shoulder portion of the spider 90 into snug juxtaposition while at the same time cinching the waistband portions 92 and 94 thereto. It also attendantly serves to adjust the buoyancy compensator.

The foregoing features while at the same time adjusting the entire buoyancy compensator around a user's waist, nevertheless maintains an independent suspension to the buoyancy compensator in its attachment to the spider 90. Not only does the independent suspension maintain itself, but it is caused to move freely by the strap 122 and attachment through the rectangular ring 124. Thus, the free movement of the buoyancy compensator as to its relationship in independent suspension with the spider 90 is maintained. At the same time, the spider 90 is secured to a person's body to maintain a secure relationship of the spider and the backpack.

Figure 6:
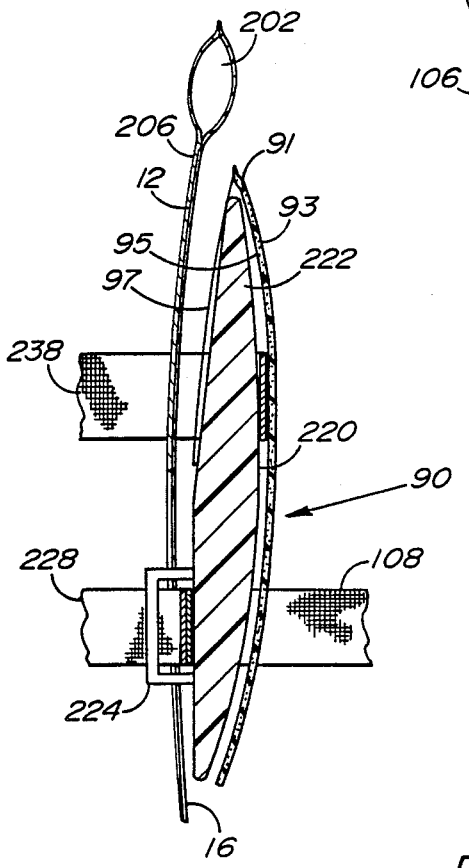
FIG. 6 shows a sectional view along lines 6—6 of FIG. 2 wherein the buoyancy compensator, backpack and spider are shown with the securement means for a cylinder of gas thereon.

The showing of FIG. 6 includes the showing of the buoyancy compensator, spider and backpack with the straps which secure the tank of gas or cylinder 60.

Figure 2:
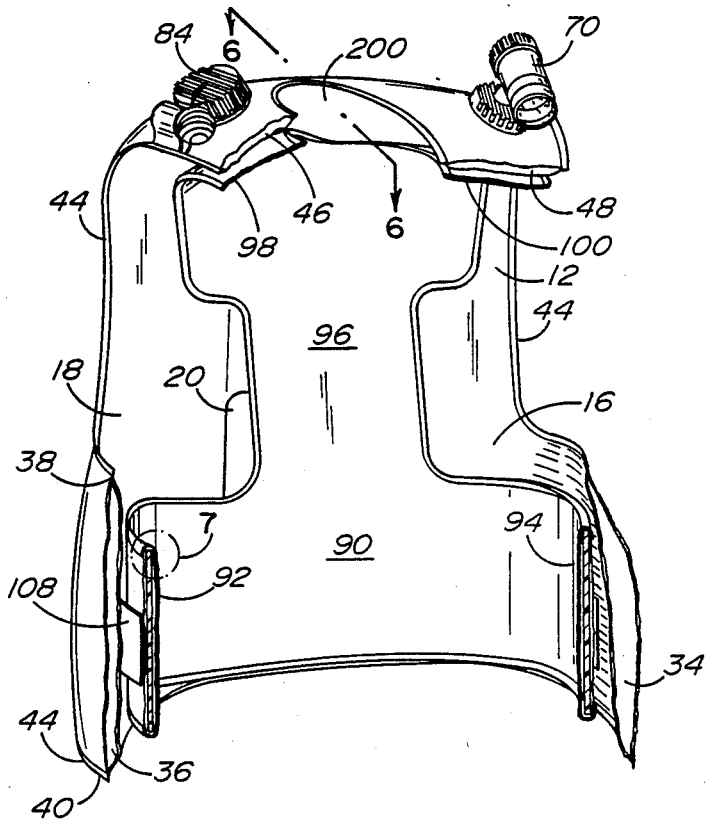
FIG. 2 shows a view similar to that of FIG. 1 that has been fragmented in the shoulder harness and spider area between the buoyancy compensator and the spider.

In particular, the sectional showing is along line 6—6 of FIG. 2. The showing is through a neck opening 200 having a void 202 which passes in part around a diver's neck. The buoyancy compensator extends downwardly on either side as can be seen with respect to back portion 12 which terminates in split back side portions 16 and 18.

Split side portion 16 is shown with the back portion 12. However, at this particular juncture, back portion 12 is in proximity to where the gas cylinder 60 is and is bonded with a heavy duty fabric overlayment 206 to the buoyancy compensator material. The buoyancy compensator is attached to the spider 90 by means of the belt 108, as previously set forth. The belt 108 passes through the buoyancy compensator and the side waistband portions 92 and 94 with respect to interweaving through at least four loops to tie the two respectively together by the belt 108 which is then secured by a buckle 109 in the front area overlapping the waistband portions 92 and 94. The belt 108 passes around the back of a backpack 220. The backpack 220 is shown sectioned and in great measure is made of a substantially solid portion of ribbed material.

The backpack 220 is shown with one of the ribs 222 sectioned and having a loop 224 extending therefrom. The loop 224 serves to secure the belt 108 around the back of the backpack, as well as a heavy duty securement belt 228 which passes around the cylinder 60. The cylinder 60 is secured again to the backpack by means of a second belt 238 shown in fragmented form which passes around the cylinder 60.

The belt 238 passes under the ribs 222 in a tightened fixed manner. The upper belt 238 is shown with an overcenter latch member 240 which secures the belt 238 around the tank. The lower belt around the tank is secured with velcro and a rectangular loop 242.

The spider 90 is shown in FIG. 6 as extending downwardly with its heavy foam material 91. The foam material 91 has a knitted inner portion 93 bonded to it and a woven outer portion 95 bonded to the outer surface. The portion of the backpack 220 toward the back has the intermediate back or spine portion 96 of the spider with a second piece of material 97 stitched thereto which overlies and partially envelopes the backpack 220. Thus, the backpack 220 is secured interiorly in part of the spider 90.

Figure 7:
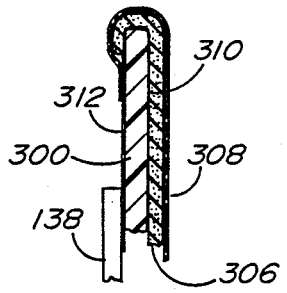
FIG. 7 shows a detailed view of the section of the backpack and spider as encircled by circle 7.

Looking more specifically at FIG. 2 and FIG. 7 which is a section taken through circle 7 of FIG. 2, it can be seen that there is a section of the side portions or waist band portions 92 and 94. The waistband portions 92 and 94 have a backpack element therein. The backpack element which is shown as backpack 220 is a one piece inverted T shaped unit that circumscribes the waist in part through the waistband portions 92 and 94. A like configuration of a backpack which circumscribes a user's waist is described in U.S. Pat. No. 4,690,314.

FIG. 7 shows the resilient backpack lateral portions of the backpack 220 as a portion of the side portion of the backpack within waistband portion 92. These side portions of the backpack are exemplified as portions 300. Portion 300 is a resilient flexible plastic waist member that when secured by the belt 138 can conform in part around a person's back and toward the sides to a user's waist and back.

The belt 138 helps to tighten the side portions 92 and 94 around a user's waist. It also provides the securement of the backpack to a user's waist so that it rests snugly against the back and side portions.

The fabric and foam of the spider waistband overlies the solid plastic portion 300. It is formed of a cellular foam 306 which is analogous to the cellular foam 91. This cellular foam 306 has a knitted fabric 308 which can be bonded thereto. The knitted fabric 308 is bonded on one side of the foam material which can have a stitched woven backing material 310 bonded therewith. The backing material 310 is a nylon type fabric. This same type of material 310 can be used not only as the backing material to form a portion of the spider, but can also in this case be stitched to the spider and overlie the plastic backpack stiffened material 300 as can be seen in the form of a fabric 312.

The fabric 312 and 310 is analogous to the fabric 95 shown in FIG. 6 which is bonded to and backs the foam 91.

The cellular foam 306 and 91 allows for the spider to expand and contract with a user's body. Additionally, the knit material 308 and 93 allows for expansion along a user's body. Please keep in mind that while separate foam portions and elements of the spider 90 have been described, the spider is formed of a continuous piece of foam, knit material and woven backing material. Thus, the spider 90 with its shoulder portions 98, 100 and spine portion 96 and waistband portions 92 and 94 expand and conform to a user's body. At the same time, the spider 90 serves to secure the backpack and the side portions, as well as the back portions.

The backpack 220 is formed as an inverted T. The vertical portion of the inverted T shape is shown in FIG. 6 and the cross members are shown in FIGS. 2 and 7 encapsulated in part by the waistband portions 92 and 94. The backpack 220 is thereby secured to a user's back to hold the gas tank or cylinder 60 thereon. At the same time, the buoyancy compensator 10 is allowed to be independently suspended on the belt 108 and at the connection points by the looped belt member 122, looping and overlying the cross member or keeper 126 of rectangular eyelet 124. In this manner, the entire buoyancy compensator can expand and contract on its two suspension points at looped portion 122 around cross member or keeper 126 and at the eyelets securing the buoyancy compensator by the belt 108 to the spider 90.

Figure 4:
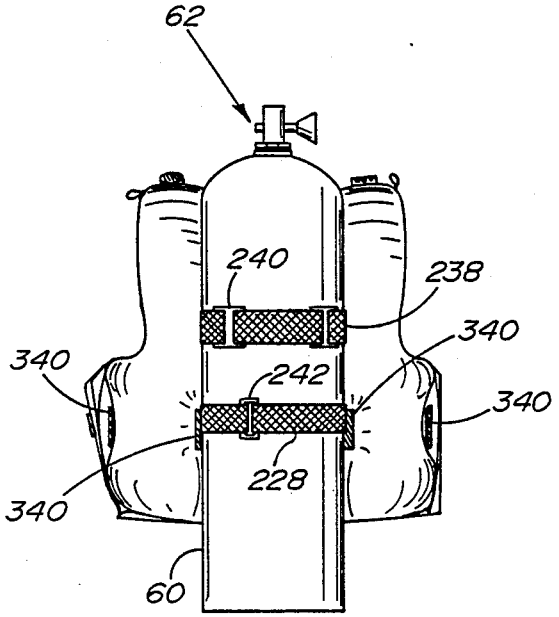
FIG. 4 shows a rear view of the buoyancy compensator with a cylinder attached to the backpack as shown from the back of FIG. 1.

As can be seen from FIG. 4, when the buoyancy compensator is expanded and inflated to the maximum degree, it is lying independently across a user's shoulders. Thus, it does not compact and restrict a user in the waist and shoulder areas. The showing of FIG. 4 shows that the belt 138 which is attached to the buoyancy compensator is attached by means of eyelet members 340. The eyelet members 340 pass through the buoyancy compensator and have an enlarged eyelet at the other end to secure the belt 108. The belt 108 can be secured to the side portions 92 and 94 by means of loops attached to the side portions. This is set forth in some measure, in U.S. Pat. No. 4,694,772.

From the foregoing and the following claims, this invention should be read broadly as an independently suspended buoyancy compensator with expansion regions allowing for independent suspension. At the same time, it allows for cross strap orientation of the straps such as those straps 98 and 100 to allow for freedom of arm movement and to fit the human anatomy more effectively. As a consequence, this invention should be read broadly in light of the following claims.

We claim:

1. A buoyancy compensation suspension system for suspending a buoyancy compensator having side portions, a back portion and shoulder portions wherein the improvement comprises:

a spider having waistband portions which extend at least partially around a user's waist, a back portion, and two shoulder portions which overlie a user's shoulders, and having means for securing the side portions of said buoyancy compensator to the waistband portions of the spider and means for securing the shoulder portions of the buoyancy compensator to the shoulder portions of the spider.

2. The suspension system as claimed in claim 1 wherein:

said spider is formed at least in part of an elastomeric stretchable material.

3. The suspension system as claimed in claim 2 wherein:

said spider elastomeric material is formed of an elastomeric foam.

4. The suspension system as claimed in claim 3 wherein:

said foam material is covered at least in part with a knitted fabric.

5. The suspension system as claimed in claim 1 further comprising:

gas cylinder support means in connected relationship to said suspension system having attachment means for receipt of a cylinder of breathing gas thereon; and wherein, said gas cylinder support means is connected in part to said suspension system by a belt attached to said suspension system.

6. The suspension system as claimed in claim 5 wherein:

said gas cylinder support means is a backpack formed in an inverted T-shaped configuration having the cross members of said T formed to contact at least a portion of the waist area of a user, and being in connected relationship to the waistband of said suspension system; and, wherein the upright portion is adapted for connection to a tank of breathing gas.

7. The suspension system as claimed in claim 1 further comprising:

adjustable shoulder straps attached between the shoulder portions of said spider and said waistband portions.

8. The suspension system as claimed in claim 7 wherein:

said shoulder straps extend from the respective shoulder portions of said suspension system to the waist portions to form a cross-over of said shoulder strap portions as attached to said waistband portions.

9. The suspension system as claimed in claim 8 wherein:

said shoulder strap portions extending from the shoulder portions to the waist portions comprise adjustable straps having a handle portion connected at one end to a strap means to said shoulder portion of said buoyancy compensator; and, at the other end to a looped strap which connects to said waistband portion and has a D ring attached to one end thereof in a manner whereby said second strap portion extends around said handle portion to form a loop with said D ring portion at the end capable of being pulled for adjustment.

10. The combination of a buoyancy compensator, suspension system and backpack for holding a tank of breathing gas for a diver comprising:

a buoyancy compensator having side portions which extend at least partially around a user's waist, and a back portion which extends to a pair of shoulder portions that overlie a user's shoulders;

means for inflating said buoyancy compensator and means for releasing gas from said buoyancy compensator;

a spider comprising waistband portions which can extend at least partially around a user's waist, a portion for extension along the midback of a user, and shoulder portions extending from said back portion for overlying a user's shoulders, and having adjustable straps extending from said shoulder portions to said waistband;

means for attachment of said buoyancy compensator to said shoulder portions of said spider and said side portions to said waistband of said spider in a flexible independently suspended and held manner to allow for independent movement of said buoyancy compensator with respect to said spider; and, backpack means for connected relationship to said spider for holding a tank of breathing gas.

11. The combination as claimed in claim 10 wherein: said spider comprises in part elastomeric material which can expand and contract with respect to a diver's outer body configuration in order to compensate for changes in depth.

12. The combination as claimed in claim 11 wherein: said elastomeric spider material comprises a cellular elastomer having a knitted fabric on at least one surface thereof to allow for the expansion and contraction thereof.

13. The combination as claimed in claim 12 wherein: said spider is attached to said buoyancy compensator by means of loops attached to said shoulder portions of said spider and loops interconnecting said side portions of said buoyancy compensator and said waistband.

14. The combination as claimed in claim 13 wherein: said backpack comprises an inverted T shaped member with the transverse portions of the T shaped member circumscribing a user's waist in part and encapsulated at least in part in the waistband portions; and, the upright of said T extends upwardly and has means connected thereto for securement of a tank of breathing gas.

15. The combination as claimed in claim 14 further comprising:

said adjustable straps extend from the waistband portions of said spider upwardly and cross over each other and respectively attach to opposite sides of the shoulder portions of said spider.

16. The combination as claimed in claim 15 wherein said straps comprise:

a first looped portion extending from said shoulder portion;

a second looped portion extending downwardly from said shoulder portion attached to said waistband portions of said spider at one end of the loop and at the other end having a handle means for pulling downwardly on said loop; and, interconnecting means between said first and second loops.

17. The combination as claimed in claim 16 wherein said interconnecting portion comprises:

a handle member having handle means for pulling downwardly or lifting upwardly to respectively cinch the strap or release the strap by relieving the bight on the second loop.

18. The combination as claimed in claim 17 further comprising:

a keeper overlying said first and second loops.

19. A diver's backpack and attachment means for said backpack in combination with a buoyancy compensator comprising:

a backpack having an upright portion with means for connecting a tank of breathing gas thereto;

a spider having a waistband portion for at least partially circumscribing around a user's waist attached to said backpack;

an upright portion of said spider that extends along the mid back portion of a user;

two extensions of said spider extending from said back portion over a user's shoulders having straps extending therefrom for attachment downwardly to the waistband portions of said spider;

a buoyancy compensator for receipt of a buoyancy compensation gas formed with a pair of side portions for extending at least partially around a user's waist and a back portion which extends upwardly to two shoulder portions;

means for attaching the shoulder portions to the shoulder portions of said spider in the form of independent connection means to allow for respective expansion and contraction of said buoyancy compensator shoulder portions without directly moving the shoulder portions of said spider; and, means for attaching the waistband portion of said spider to the side portions of said buoyancy compensator to provide for expansion and contraction of said side portions independently of said expansion and contraction of said spider.

20. The combination as claimed in claim 19 wherein: said spider is formed of an elastomeric material for expansion and contraction when in contact with a user.

21. The combination as claimed in claim 20 wherein: said spider elastomeric material is formed of a foamed elastomer having a knitted fabric attached thereto.

22. The combination as claimed in claim 19 wherein: said straps connecting said shoulder portions to said waistband portions extend from one side of said buoyancy compensator toward the other side.

* * * * *